United States Patent [19]

Vollhardt et al.

[11] Patent Number: 4,768,445

[45] Date of Patent: Sep. 6, 1988

[54] WASTE INCINERATOR CONSTRUCTION

[75] Inventors: Frohmut Vollhardt, Oberhausen; Hans Krämer, Dinlaken; Rudolf Fischer, Dorsten, all of Fed. Rep. of Germany

[73] Assignee: MAN Gutehoffnungshutte GmbH, Fed. Rep. of Germany

[21] Appl. No.: 107,387

[22] Filed: Oct. 9, 1987

[30] Foreign Application Priority Data

Oct. 26, 1986 [DE] Fed. Rep. of Germany ..... 3635415

[51] Int. Cl.[4] ..... F23B 5/00; F23C 9/00; F23G 7/06

[52] U.S. Cl. ..... 110/210; 110/246; 110/336; 110/341

[58] Field of Search ..... 110/246, 211, 226, 210, 110/336, 341, 184; 165/81; 122/510

[56] References Cited

U.S. PATENT DOCUMENTS 4,350,102 9/1982 Ruegg ..... 110/246

4,510,892 4/1985 Wincze et al. ..... 165/81 X 4,554,876 11/1985 Grachtrup ..... 110/246

*Primary Examiner*—Edward G. Favors

*Attorney, Agent, or Firm*—McGlew and Tuttle

[57] ABSTRACT

A waste incinerator, especially for waste products from the chemical industry, comprising a horizontal, stationary or revolving, combustion chamber, and a vertical, brick lined afterburning chamber with circular cross section. The steel casing of the afterburning chamber is supported on an exterior furnace framework by means of a supporting ring on the chamber above the burner supported on a horizontal supporting frame. An upper steel casing segment of the afterburning chamber is separated from a lower steel casing segment above the entrance of the horizontal combustion chamber by a separating joint. The afterburing chamber above the joint is suspended by a supporting ring engaged over a horizontal frame of the furnace framework. The joint is spanned by a compensator.

9 Claims, 1 Drawing Sheet

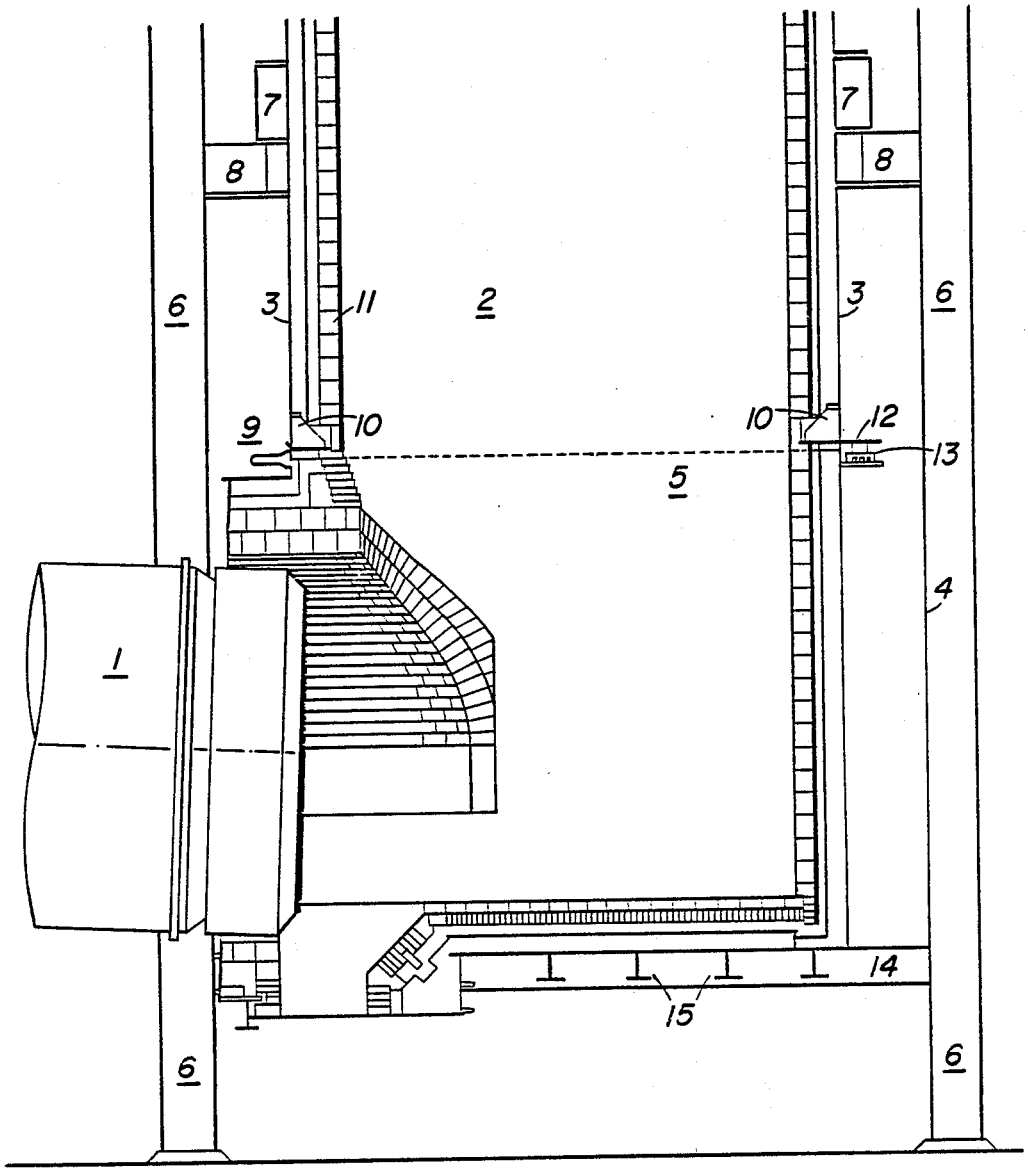
7
8
6
3
11
2
9
10
5
1
4
12
13
14
15

WASTE INCINERATOR CONSTRUCTION

BACKGROUND OF THE INVENTION

Field of the Invention

The invention relates in general to furnaces and in particular to a new and useful waste incinerator, especially for wastes from the chemical industry, and comprising a horizontal, stationary or revolving, combustion chamber, and a cylindrical, vertical, brick lined afterburning chamber with a steel casing and a supporting frame.

The patent of Krauss-Maffei "Rotating Tubular Furnace", 2nd edition, presents a rotating tube furnace for incineration of solid, pasty or liquid industrial waste in the sense of a superimposed concept.

SUMMARY OF THE INVENTION

The invention provides a waste incinerator having a horizontal combustion chamber with a vertical afterburning chamber attached thereto, for example, to relieve the entrance of the horizontal combustion chamber into the vertical afterburning chamber from the stress of the steel casing and the masonry impinging on this transitional region, so that no expensive reinforcement is necessary.

In the invented solution, the generally complicated entrance of the horizontal combustion chamber into the vertical afterburning chamber is relieved of stress. Without this invented measure, the entire weight would lie on this transitional region and it would be necessary to provide a costly reinforcement structure in the vault casing of the vertical combustion chamber, in the steel casing of the vertical afterburning chamber, and especially in the transitional region of the two chambers.

The invention arrangement also achieves a relief of the complicated transitional region from the superposed pressure of the masonry. This eliminates the additional load of the vault from the especially mechanically and thermally stressed transitional region.

In the invention, a very simple reinforcing structure between vault casing of the horizontal combustion chamber and steel casing of the vertical afterburning chamber is employed only to maintain the stability of shape of the refractory lining against thermal expansion (thrust of the brickwork), but not to transfer the load.

The horizontal separation of the vertical chamber into an upper and a lower segment by means of a joint, as in the invention, makes it possible to absorb the axial expansions.

The compensator spanning the joint not only provides gas tightness, but also assures coaxial positioning of the upper and lower segment of the steel casing of the vertical chamber. This is achieved by the special configuration of the compensator, which has stiff sides, similar to the compensators between shell and port-end of a blast furnace.

Coaxial positioning can also be achieved, alternatively or supplementarily, by flange rings, provided with guide shoes, at the separation between the upper and the lower segment of the steel casing.

According to the invention, the weight of the portion of the afterburning chamber below the joint is shifted onto the supporting frame across a structure of lengthwise and transverse girders.

The various features of novelty which characterize the invention are pointed with particularity in the claims annexed to and forming apart of this disclosure.

For a better understanding of the invention its operating advantages and specific objects obtained by its uses, reference is made to the accompanying drawing and descriptive matter in which a preferred embodiment of the invention is illustrated.

Accordingly, it is an object of the invention to provide an improved furnace construction, such as a waste incinerator which includes the vertically elongated afterburner part having separated upper and lower portions with the lower portion having an opening into which a horizontally extending combustion chamber extends and which includes a supporting frame exteriorly of the afterburner part with a support structure for supporting the upper portion above the lower portion.

A further object of the invention is to provide a method of operating an incinerator which includes a vertically elongated afterburner part having upper and lower portions with a horizontally extending combustion chamber extending into an opening in the lower portion, which comprises suspending the upper portion of the afterburner part on an exterior framework, so that it forms a joint with and is above the lower portion, supporting the lower portion from below while operating the horizontally extending combustion chamber to burn the material, and providing a compensator structure at the joint between the upper and lower portions during the operation which closes off the interior space of the afterburner part.

A further object of the invention is to provide an incinerator which is simple in design, rugged in construction and economical to manufacture.

While a specific embodiment of the invention has been shown and described in detail to illustrate the application of the principals of the invention, it will be understood that the invention may be embodied otherwise without departing from such principals.

BRIEF DESCRIPTION OF THE DRAWINGS

The only FIGURE of the drawings is an axial sectional view, partly in elevation with incinerator constructed in accordance with the invention.

GENERAL DESCRIPTION OF THE PREFERRED EMBODIMENTS

Referring to the drawings, in particular, the invention embodied therein comprises an incinerator which includes a vertically elongated afterburner part 2 which has a separated upper portion 3 and lower portion 4 which are advantageously separated along a horizontally extending joint 5.

In accordance with the invention, the lower part 4 is supported on supporting means including transverse girders 14 and longitudinally extending girders 15 forming a floor 16 on supporting frame work 6 upon which the lower portion 4 rests. The lower portion 4 has a horizontal combustion chamber receiving opening into which an end portion of a horizontally extending combustion chamber part 1 extends.

In accordance with the method of operation of the invention, combustion is established in the combustion chamber part 1 and the gaseous products of combustion proceed into the afterburner chamber 2 and during a compensator means 9 is provided along the joint 5 in the form of a bellows-like element which insures that the gases do not escape. The arrangement permits free movement of the horizontal combustion chamber 1 which, for example, may be rotated without interfering with the brickwork or other construction of the lower part 4 or the upper part 3 of afterburning chamber 2.

The single patent illustration shows a vertical section of the lower part of the afterburnig chamber 2 with partial view of the entrance of the horizontal combustion chamber 1, here configured as a revolving tube furnace.

In the transitional region between the horizontal combustion chamber 1 and the afterburning chamber 2 the vaulting is configured according to the state of the art.

The afterburnig chamber 2 is surrounded by a supporting framework 6, whose counterbrackets are shown. Above the vaulting, the afterburning chamber 2 is divided into an upper part 3 and a lower part 4 by a horizontal joint 5.

The upper part 3 of the afterburning chamber is buttressed on a horizontal supporting frame 8 by means of a supporting ring 7. The frame 8 is bound into the supporting framework 6.

The weight of masonry or brickwork 11 above the joint 5 is shifted to the upper part 3 of the steel casing by means of a console ring 10. The weight of the steel structure and the brickwork 4 below the joint 5 is shifted to the furnace framework 16 across lengthwise 14 and the transverse girders 15.

At the left of the figure, the joint 5 is shown spanned by a compensator 9. On the right side, as an alternative, there are shown two flange rings 12, connected by guide shoes 13. With such design, the sealing function is achieved by a correspondingly smaller sized compensator or a suitable packing.

While a specific embodiment of the invention has been shown and described in detail to illustrate the application of the principals of the invention, it will be understood that the invention may be embodied otherwise without departing from such principals.

What is claimed is:

1. A waste incinerator, especially for waste products from the chemical industry, comprising a horizontal combustion chamber, a cylindrical vertically extending bricklined afterburning chamber connected to said horizontal combustion and having a steel casing outer wall, a load supporting framework adjacent said afterburning chamber, said afterburning chamber being horizontally above said horizontal combustion chamber into upper and lower portions, said upper portion defining an afterburning chamber above the connection of said horizontal combustion chamber, a supporting ring on said upper portion, a horizontal frame on said framework on which said supporting ring rests, said framework having a structure of lengthwise and transverse girders below said lower portion on which said lower portion is supported.

2. A waste incinerator according to claim 1, wherein said upper portion has a steel casement segment above the joint between said upper and lower portions, said ring being arranged around said steel casement segments and supporting masonry above said joint.

3. A waste incinerator according to claim 1, including a compensator spanning the joint between said upper and lower portion.

4. A waste incinerator according to claim 1, including a flange ring arranged at the ends of said lower and upper portions which are abutting having guide shoes thereon which interengage.

5. A method of operating an incinerator which includes a vertically elongated afterburner part having upper and lower portions with a horizontally extending combustion chamber extending into an opening in the lower portion, which comprises, fastening an interior ring to the interior of an exterior framework and fastening an exterior ring to the exterior of an upper portion of the afterburner part and suspending the exterior ring of the upper portion of the afterburner part on the interior ring of the exterior framework, so that it forms a joint with and is aligned above the lower portion, supporting the lower portion from below while operating the horizontally extending combustion chamber to burn the material, and providing a compensator structure at the joint between the upper and lower portions which closes off the interior space of the afterburner part.

6. An incinerator comprising a vertically elongated afterburner part having separated upper and lower portions, said lower portion having a horizontal combustion chamber receiving opening, a horizontally extending combustion chamber part extending into said combustion chamber receiving opening, a supporting frame exteriorly of said afterburner part, and supporting means supporting said upper portion above said lower portion on said supporting frame, said supporting means includes a horizontal member on said supporting frame and a ring carried on the upper portion resting on said horizontal member.

7. An incinerator according to claim 6, wherein said supporting means includes a horizontal supporting floor carried by said supporting frame on which said lower portion is supported.

8. An incinerator according to claim 6, including a compensator connected to said upper and lower portions and bridging the joint between said portions.

9. An incinerator according to claim 6, wherein said upper and lower portion includes opposing ends with flange rings having opposite guide shoes.

* * * * *